US007772544B2

(12) United States Patent
Chen et al.

(10) Patent No.: US 7,772,544 B2
(45) **Date of Patent: *Aug. 10, 2010**

(54) NEUTRAL BEAM SOURCE AND METHOD FOR PLASMA HEATING

(75) Inventors: Lee Chen, Cedar Creek, TX (US); Merritt Funk, Austin, TX (US)

(73) Assignee: Tokyo Electron Limited, Tokyo (JP)

( * ) Notice: Subject to any disclaimer, the term of this patent is extended or adjusted under 35 U.S.C. 154(b) by 390 days.

This patent is subject to a terminal disclaimer.

(21) Appl. No.: 11/869,656

(22) Filed: Oct. 9, 2007

(65) Prior Publication Data

US 2009/0090852 A1 Apr. 9, 2009

(51) Int. Cl.
*H05H 3/02* (2006.01)

(52) U.S. Cl. ..... 250/251; 250/492.21; 250/423 R

(58) Field of Classification Search ..... 250/251
See application file for complete search history.

(56) References Cited

U.S. PATENT DOCUMENTS 5,082,685 A * 1/1992 Morooka ..... 427/577
5,468,955 A 11/1995 Chen et al.
6,331,701 B1 12/2001 Chen et al.
6,335,535 B1 * 1/2002 Miyake et al. ..... 250/492.21
6,503,050 B2 * 1/2003 Reimer et al. ..... 415/90
6,809,310 B2 10/2004 Chen
6,909,087 B2 * 6/2005 Ichiki et al. ..... 250/251
2007/0069118 A1 3/2007 Chen et al.
2007/0221833 A1 * 9/2007 Yeom et al. ..... 250/251

OTHER PUBLICATIONS

International Searching Authority, International Search Report and Written Opinion, International Application No. PCT/US08/78618, Mailed Dec. 5, 2008, 8 pages (ISR References cited in earlier IDS filed Oct. 9, 2007).

U.S. Office Action issued in U.S. Appl. No. 12/126,456 mailed Dec. 14, 2009.

* cited by examiner

*Primary Examiner*—David A. Vanore
*Assistant Examiner*—Phillip A. Johnston

(57) ABSTRACT

Method and system for producing a neutral beam source is described. The neutral beam source comprises a plasma generation system for forming a first plasma in a first plasma region, a plasma heating system for heating electrons from the first plasma region in a second plasma region to form a second plasma, and a neutralizer grid for neutralizing ion species from the second plasma in the second plasma region. Furthermore, the neutral beam source comprises a pumping system that enables use of the neutral beam source for semiconductor processing applications, such as etching processes.

20 Claims, 5 Drawing Sheets

NEUTRAL BEAM SOURCE AND METHOD FOR PLASMA HEATING

BACKGROUND OF THE INVENTION

1. Field of the Invention

The invention relates to a method and system for operating a neutral beam source for treating a substrate and, more particularly, to a method and system for creating a neutral beam and pumping a processing system utilizing a neutral beam source.

2. Description of Related Art

During semiconductor processing, plasma is often utilized to assist etch processes by facilitating the anisotropic removal of material along fine lines or within vias (or contacts) patterned on a semiconductor substrate. Furthermore, plasma is utilized to enhance the deposition of thin films by providing improved mobility of adatoms on a semiconductor substrate.

For example, during dry plasma etching, a semiconductor substrate having an overlying patterned, protective layer, such as a photoresist layer, is positioned on a substrate holder in a plasma processing system. Once the substrate is positioned within the chamber, an ionizable, dissociative gas mixture is introduced, whereby the chemical composition is specially chosen for the specific material being etched on the semiconductor substrate. As the gas is introduced, excess gases are evacuated from the plasma processing system using a vacuum pump.

Thereafter, plasma is formed when a fraction of the gas species present are ionized by electrons heated via the transfer of radio frequency (RF) power either inductively or capacitively, or microwave power using, for example, electron cyclotron resonance (ECR). Moreover, the heated electrons serve to dissociate some species of the ambient gas species and create reactant specie(s) suitable for the exposed surface etch chemistry. Once the plasma is formed, selected surfaces of the substrate are etched by the plasma.

The process is adjusted to achieve appropriate conditions, including an appropriate concentration of desirable reactant and ion populations to etch various features (e.g., trenches, vias, contacts, etc.) in the selected regions of the substrate. Such substrate materials where etching is required include silicon dioxide ($SiO_2$), low-k dielectric materials, poly-silicon, and silicon nitride.

However, the use of plasma (i.e., electrically charged particles), itself, produces problems in the manufacture of semiconductor devices. As devices have become smaller and integration densities have increased, breakdown voltages of insulation and isolation structures therein have, in many instances, been markedly reduced, often to much less than ten volts. For example, some integrated circuit (IC) device designs call for insulators of sub-micron thicknesses.

At the same time, the reduction of the size of structures reduces the capacitance value of the insulation or isolation structures, and relatively fewer charged particles are required to develop an electric field of sufficient strength to break down insulation or isolation structures. Therefore, the tolerance of semiconductor structures for the charge carried by particles impinging on them during the manufacturing process, such as a dry plasma etching process, has become quite limited and the structures for dissipating such charges during manufacture are sometimes required, often complicating the design of the semiconductor device.

While this problem could be avoided by performing processing with neutrally charged particles, the charge of an ion or electron is the only property by which the motion of these particles can be effectively manipulated and guided. Therefore, an ion must remain in a charged state until its trajectory can be established and the energy of the ion must be sufficient that its trajectory will remain unchanged when neutralized by an electron. Even then, the trajectory may be altered and the flux of a neutral beam can be severely depleted by collisions with other particles which may or may not have been neutralized and which may have trajectories which are not precisely parallel.

As a result of this need, neutral beam sources have been developed to produce a beam of neutrally charged particles of arbitrary energy which may be as low as a few electron volts and as large as tens of thousands of electron volts or larger.

SUMMARY OF THE INVENTION

The invention relates to a method and system for operating a neutral beam source for treating a substrate and, more particularly, to a method and system for creating a neutral beam and for pumping a processing system utilizing a neutral beam source.

The invention relates to a method and system for producing a hyperthermal neutral beam source. The neutral beam source comprises a plasma generation system for forming plasma in a first plasma region, a plasma heating system for heating electrons from the first plasma region in a second plasma region, and a neutralizer grid for neutralizing ion species from plasma in the second plasma region. Furthermore, the neutral beam source comprises a pumping system that enables use of the hyperthermal neutral beam source for semiconductor processing applications, such as etching processes.

According to one embodiment, a processing system configured to treat a substrate is described. The processing system comprises a neutral beam source comprising: a beam chamber comprising a first plasma region configured to receive a first process gas at a first pressure and a second plasma region disposed downstream of the first plasma region and configured to receive the first process gas from the first plasma region at a second pressure; a first gas injection system coupled to the beam chamber and configured to introduce the first process gas to the first plasma region; a plasma generation system coupled to the beam chamber and configured to generate a first plasma in the first plasma region from the first process gas; a separation member disposed between the first plasma region and the second plasma region, wherein the separation member comprises one or more openings configured to allow transport of electrons from the first plasma region to the second plasma region; a plasma heating system coupled to the beam chamber and configured to heat the electrons in the second plasma region to form a second plasma; and a neutralizer grid coupled to an outlet of the neutral beam source and configured to neutralize a flow of ions from the second plasma through the neutralizer grid in order to form the neutral beam. Furthermore, the neutral beam source is configured to be coupled to a process chamber. The process chamber is configured to receive the neutral beam in a processing space, wherein the process chamber comprises a substrate holder configured to support the substrate and position the substrate for treatment by the neutral beam. Additionally, a vacuum pumping system is coupled to the process chamber and configured to pump the processing space in the process chamber, and is coupled to the neutral beam source and configured to pump the first plasma region or the second plasma region or both in the neutral beam source.

According to another embodiment, a method for treating a substrate with a neutral beam is described, comprising: disposing the substrate in a processing chamber configured to treat the substrate with the neutral beam; forming the neutral beam using a neutral beam source coupled to the processing chamber, wherein the forming comprises creating a first plasma in a first plasma region, transporting electrons from the first plasma in the first plasma region to a second plasma region, heating the electrons in the second plasma region, and neutralizing ions from the second plasma region; pumping the neutral beam source using a vacuum pumping system coupled to the neutral beam source; pumping the processing chamber using the vacuum pumping source coupled to the processing chamber; and exposing the substrate to the neutral beam.

DETAILED DESCRIPTION OF EXEMPLARY EMBODIMENTS

In the following description, to facilitate a thorough understanding of the invention and for purposes of explanation and not limitation, specific details are set forth, such as a particular geometry of the neutral beam source and the processing system and various descriptions of the system components. However, it should be understood that the invention may be practiced with other embodiments that depart from these specific details.

Nonetheless, it should be appreciated that, contained within the description are features which, notwithstanding the inventive nature of the general concepts being explained, are also of an inventive nature.

Figure 1:
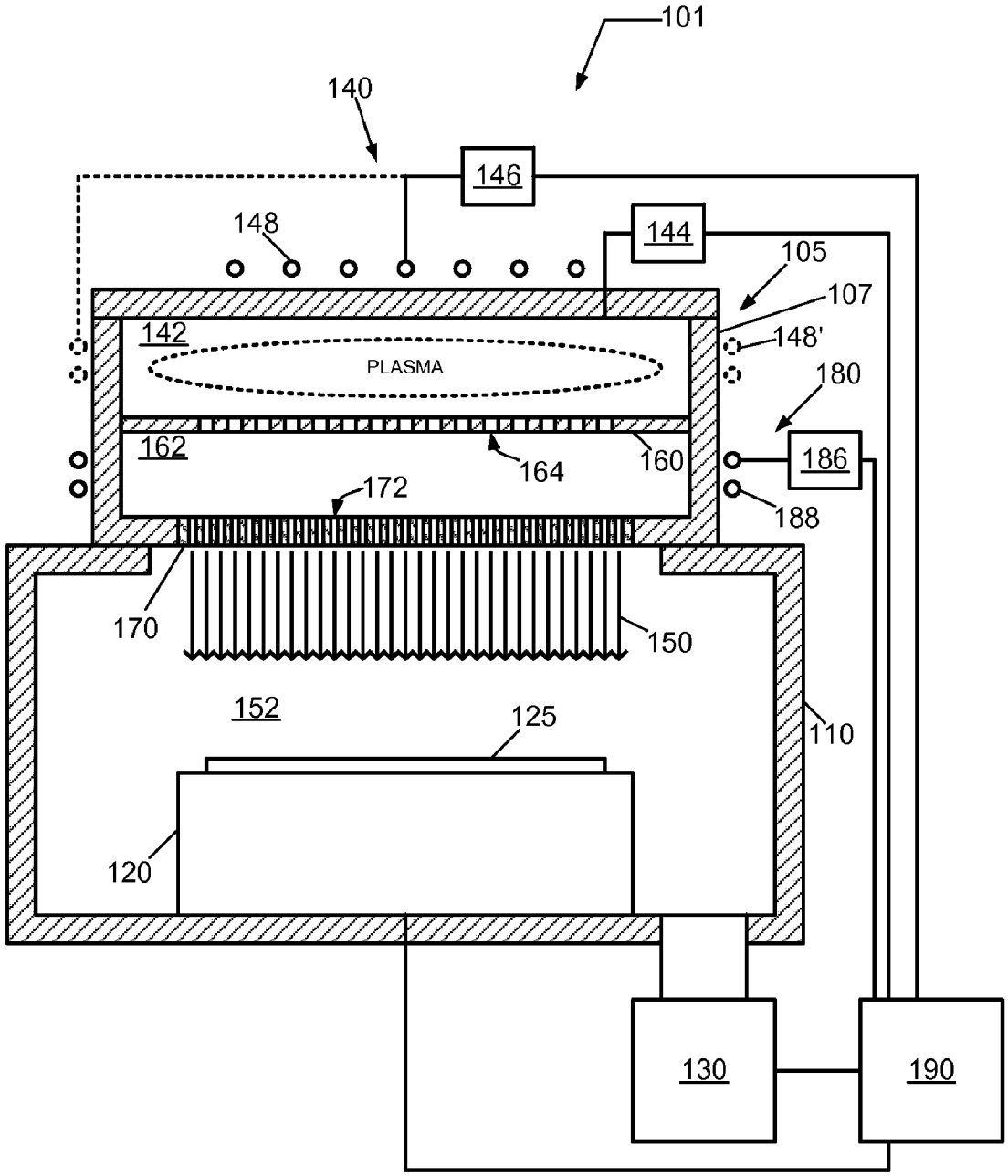
FIG. 1 shows a neutral beam source coupled to a processing system according to an embodiment.

Referring now to the drawings, wherein like reference numerals designate identical or corresponding parts throughout the several views, FIG. 1 depicts a processing system 101 comprising a neutral beam source 105 configured to produce a neutral beam 150, and a process chamber 110 configured to provide a contaminant-free, vacuum environment for processing a substrate 125 with the neutral beam. The process chamber 110 comprises a substrate holder 120 configured to support substrate 125, and a vacuum pumping system 130 coupled to the process chamber 110 and configured to evacuate the process chamber 110.

The neutral beam source 105 comprises a beam chamber 107 having a first plasma region 142 configured to receive a first process gas at a first pressure and form a first plasma. Furthermore, the beam chamber 107 comprises a second plasma region 162 disposed downstream of the first plasma region 142 and configured to receive electrons and the first process gas from the first plasma region 142 and form a second plasma therein at a second pressure.

A first gas injection system 144 is coupled to the beam chamber 107, and configured to introduce the first process gas to the first plasma region 142. The first process gas may comprise an electropositive gas or an electronegative gas or a mixture thereof. For example, the first process gas may comprise a noble gas, such as Ar. Additionally, for example, the first process gas may comprise any gas suitable for treating substrate 125. Furthermore, for example, the first process gas may comprise any gas having chemical constituents, atomic or molecular, suitable for treating substrate 125. The first gas injection system 144 may include one or more gas supplies or gas sources, one or more control valves, one or more filters, one or more mass flow controllers, etc.

An optional second gas injection system (not shown) may be coupled to the beam chamber 107, and configured to introduce a second process gas to the second plasma region 162. The second process gas may comprise any gas suitable for treating substrate 125. Additionally, for example, the second process gas may comprise any gas having chemical constituents, atomic or molecular, suitable for treating substrate 125. The second gas injection system may include one or more gas supplies or gas sources, one or more control valves, one or more filters, one or more mass flow controllers, etc.

According to one example, when producing an oxygen neutral beam, the first process gas may comprise $O_2$ with or without Ar. According to another example, when producing an oxygen neutral beam, the first process gas may comprise $O_2$ with or without Ar, and the second process gas may comprise $O_2$. According to yet another example, when producing an oxygen neutral beam, the first process gas may comprise Ar, and the second process gas may comprise $O_2$.

Referring still to FIG. 1, the neutral beam source 105 comprises a plasma generation system 140 coupled to the beam chamber 107 and configured to generate the first plasma in the first plasma region 142. The neutral beam source 105 further comprises a plasma heating system 180 coupled to the beam chamber 107 and configured to heat electrons from the first plasma region 142 to form the second plasma in the second plasma region 162.

The plasma generation system 140 can comprise a system configured to produce a capacitively coupled plasma (CCP), an inductively coupled plasma (ICP), a transformer coupled plasma (TCP), a surface wave plasma, a helicon wave plasma, or an electron cyclotron resonant (ECR) heated plasma, or other type of plasma understood by one skilled in the art of plasma formation.

For example, the plasma generation system 140 may comprise an inductive coil 148 which is coupled to power source 146. The power source 146 may comprise a radio frequency (RF) generator that couples RF power through an optional impedance match network to coil 148. RF power is inductively coupled from inductive coil 148 through a dielectric window (not shown) to plasma in the first plasma region 142. A typical frequency for the application of RF power to the inductive coil can range from about 10 MHz to about 100 MHz. In addition, a slotted Faraday shield (not shown) can be employed to reduce capacitive coupling between the inductive coil 148 and plasma.

An impedance match network may serve to improve the transfer of RF power to plasma by reducing the reflected power. Match network topologies (e.g. L-type, π-type, T-type, etc.) and automatic control methods are well known to those skilled in the art.

As illustrated in FIG. 1, the inductive coil 148 can be a "spiral" coil or "pancake" coil in communication with the plasma from above as in a transformer coupled plasma (TCP). Alternatively, as illustrated in FIG. 1, the inductive coil may include a helical coil 148'. The design and implementation of an ICP source, or TCP source, is well known to those skilled in the art.

As an example, in an electropositive discharge, the electron density may range from approximately $10^{10}$ $cm^{-3}$ to $10^{13}$ $cm^{-3}$, and the electron temperature may range from about 1 eV to about 10 eV (depending on the type of plasma source utilized).

The plasma heating system 180 is configured to heat electrons from the first plasma region 142 in the second plasma region 162 by utilizing capacitively coupled plasma (CCP) technology, inductively coupled plasma (ICP) technology, transformer coupled plasma (TCP) technology, surface wave plasma technology, helicon wave plasma technology, or electron cyclotron resonant (ECR) heated plasma technology, or other type of plasma technology understood by one skilled in the art of plasma formation.

For example, the plasma heating system 180 may comprise an inductive coil 188 which is coupled to power source 186. The power source 186 may comprise a RF generator that couples RF power through an optional impedance match network to coil 188. RF power is inductively coupled from inductive coil 188 through a dielectric window (not shown) to plasma in the second plasma region 162. A typical frequency for the application of RF power to the inductive coil can range from about 10 MHz to about 100 MHz. In addition, a slotted Faraday shield (not shown) can be employed to reduce capacitive coupling between the inductive coil 188 and plasma.

An impedance match network may serve to improve the transfer of RF power to plasma by reducing the reflected power. Match network topologies (e.g. L-type, π-type, T-type, etc.) and automatic control methods are well known to those skilled in the art.

Referring still to FIG. 1, a separation member 160 is disposed between the first plasma region 142 and the second plasma region 162, wherein the separation member 160 comprises one or more openings 164 configured to allow the passage of the first process gas as well as the transport of electrons from the first plasma in the first plasma region 142 to the second plasma region 162 in order to form the second plasma in the second plasma region 162. The one or more openings 164 in the separation member 160 may comprise super-Debye length apertures, i.e., the transverse dimension or diameter is larger than the Debye length. The one or more openings 164 may be sufficiently large to permit adequate electron transport, and the one or more openings 164 may be sufficiently small to prevent or reduce electron heating across the separation member 160. The one or more openings 164 may be sufficiently small to sustain a pressure difference between the first pressure in the first plasma region 142 and the second pressure in the second plasma region 162.

As illustrated in FIG. 1, electrons are transported from the first plasma region 142 to the second plasma region 162 through separation member 160. The electron transport may be driven by diffusion, or it may be driven by field-enhanced diffusion. As electrons emerge from the separation member 160 and enter the second plasma region 162, they are heated by plasma heating system 180.

In this configuration, where electrons are fed from the first plasma region 142 to the second plasma region 162 and heated in the second plasma region 162, the second pressure may be low relative to the first pressure in the first plasma region 142. For example, the first pressure may be approximately an order of magnitude larger (e.g., 10 times greater (10×), 20×,30×, etc.) than the second pressure. Additionally, for example, the first pressure may be selected for ease of plasma ignition and for efficient generation of plasma, while the second pressure is selected to be relatively low in order to reduce or minimize collisions in the second plasma region 162. Further yet, for example, the first pressure may range from about 10 mtorr (millitorr) to about 500 mtorr, e.g., about 10 mtorr to about 100 mtorr (e.g., 30 mTorr), while the second pressure may range from about 0.1 mtorr (millitorr) to about 10 mtorr, e.g., about 1 mtorr to about 10 mtorr (e.g., 3 mtorr).

Processing system 101 further comprises a neutralizer grid 170 coupled to an outlet of the process chamber 110, and configured to partly or fully neutralize ions from the second plasma region 162. The neutralizer grid 170 comprises one or more apertures 172 for neutralizing ion species as these species pass through. The neutralizer grid 170 may be coupled to ground or it may be electrically biased. The neutralizer grid 170 may be a sub-Debye neutralizer grid. The one or more apertures 172 may be, for instance, approximately 1 mm in diameter and 12 mm in length.

If the diameter (or transverse dimension(s)) of the one or more apertures 172 is on the order of or smaller than the Debye length (i.e., a sub-Debye dimension) and the aspect ratio (i.e., ratio of longitudinal dimension L to transverse dimension d) is maintained at approximately 1:1 or larger, then the geometry of the plasma sheath is substantially unaffected from the geometry which would be caused by an unapertured neutralizer grid (i.e., a planar wall) and remains substantially planar.

Therefore, a region where ion and electron recombination are favored will exist adjacent to but not necessarily within the aperture and the number of energetic neutral particles will be made to increase relative to the ion population. Furthermore, plasma formed upstream of the neutralizer grid is confined and does not form a charged particle flux through the aperture. The flux of particles through the aperture, however, will also contain some effusive neutral beam component, although the effusive neutral beam component may be reduced by increasing the aspect ratio of the one or more apertures.

The neutralizer grid 170 may be fabricated from a conductive material or a non-conductive material. For example, the neutralizer grid 170 may be fabricated from $RuO_2$ or Hf. Additionally, for example, other materials may include silicon-containing materials, such as silicon, doped silicon, polycrystalline silicon, silicon carbide, silicon nitride, silicon oxide, quartz, etc. Furthermore, for example, the neutralizer grid 170 may be fabricated from a conductive material or a non-conductive material, and it may be coated with a protective barrier.

Additional details for a hyperthermal neutral beam source having a sub-Debye length neutralizer grid is provided in U.S. Pat. No. 5,468,955, entitled "Neutral beam apparatus for in-situ production of reactants and kinetic energy transfer".

As the neutral beam diameter increases, for example, from approximately one (1) inch to approximately thirteen (13) inches or greater (in order to process a 300 mm diameter substrate, or 450 mm diameter substrate, etc.), the diameter of the neutralizer grid 170 must increase to approximately thirteen (13) inches as well. One problem associated with a large diameter neutral beam is an increased gas-load. As the diameter of the neutralizer grid 170 is increased, the total gas conductance (for the thermal gas) of the neutralizer grid increases proportionally to the open area. Of course, the conductance of the individual high aspect-ratio sub-Debye opening remains constant.

As an example, one arrangement for pumping a neutral beam source is illustrated in FIG. 1. All of the atoms/molecules (thermal and hyperthermal) pass through neutralizer grid 170, and enter processing space 152 in process chamber 110. Vacuum pumping system 130 comprises a turbo-molecular pump (TMP), which is coupled to process chamber 110 in order to maximize the flow conductance between the inlet of the vacuum pump and processing space 152 (i.e., the region of substrate 125). The gas pressure of processing space 152 should be sufficiently low (e.g., <1 mtorr) in order to prevent collisions with the gas which would cause the neutral beam 150 to lose its directionality.

For example, a desirable pressure can be approximately $1\times10^{-4}$ Torr, or less. When the diameter of neutralizer grid 170 is approximately thirteen (13) inches, the net flow conductance through the separation member 160 and the neutralizer grid 170 is approximately 100 liters/second (l/sec). In order to achieve a pressure desirable for forming plasma in first plasma region 142 (i.e., 30 mtorr) and to achieve a pressure desirable for processing substrate 125 in processing space 152 (i.e., $1\times10^{-4}$ torr), the vacuum pumping system 130 would be required to deliver approximately 30,000 l/sec to processing space 152.

For instance, the throughput (measured as torr-l/sec) of gas passing through neutralizer grid 170 can be expressed as: $Q=C*(P_1-P_2)$, where Q represents the gas throughput (torr-l/sec), C represents the flow conductance through the separation member 160 and the neutralizer grid 170 (l/sec), $P_1$ represents the gas pressure (torr) in the first plasma region 142, and $P_2$ represents the gas pressure (torr) in processing space 152. Additionally, the throughput can be represented as $Q=P_2S_2$, where $S_2$ represents the pumping speed delivered to the processing space 152 in order to achieve a gas pressure of $P_2$ for a throughput Q. Upon considering the conservation of mass, a steady flow requires that the two expressions for gas throughput be equivalent, hence, $P_2S_2=C*(P_1-P_2)$, or $S_2=C*(P_1-P_2)/P_2$. For the conditions stated above (i.e., C~100 l/sec, $P_1$~30 mtorr, and $P_2$~0.1 mtorr), the pumping speed $S_2$ delivered to processing space 152 must be at least 30,000 l/sec (which places greater demands on the vacuum pump or pumps if the flow conductance between processing space 152 and the inlet to the vacuum pump is not substantially larger than the pumping speed at the inlet to the vacuum pump).

Figure 2A:
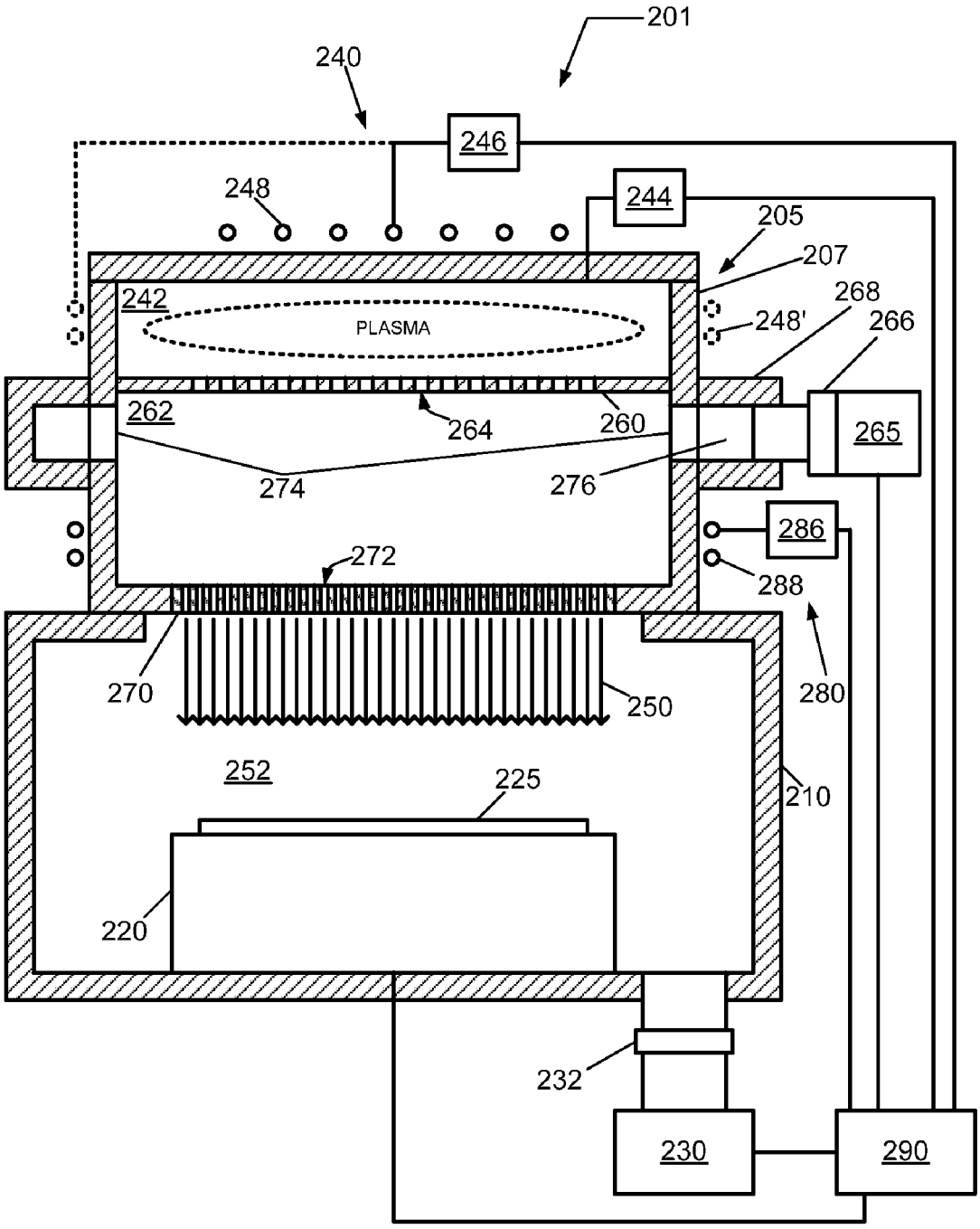
FIG. 2A presents a neutral beam source coupled to a processing system according to an embodiment.

Therefore, referring now to FIG. 2A wherein like reference numerals designate identical or corresponding parts throughout the several views, a processing system 201 comprising a neutral beam source 205 configured to produce a neutral beam, and a process chamber 210 configured to provide a contaminant-free, vacuum environment for processing a substrate 225 with a neutral beam 250 is provided according to an embodiment of the invention. The process chamber 210 comprises a substrate holder 220 configured to support substrate 225.

The neutral beam source 205 comprises a beam chamber 207 having a first plasma region 242 configured to receive a first process gas at a first pressure and form a first plasma. Furthermore, the beam chamber 207 comprises a second plasma region 262 disposed downstream of the first plasma region 242 and configured to receive electrons from the first plasma region 242 and form a second plasma therein at a second pressure.

A first gas injection system 244 is coupled to the beam chamber 207, and configured to introduce the first process gas to the first plasma region 242. The first process gas may comprise an electropositive gas or an electronegative gas or a mixture thereof. For example, the first process gas may comprise a noble gas, such as Ar. Additionally, for example, the first process gas may comprise any process gas suitable for treating substrate 225. The first gas injection system 244 may include one or more gas supplies or gas sources, one or more control valves, one or more filters, one or more mass flow controllers, etc.

An optional second gas injection system (not shown) may be coupled to the beam chamber 207, and configured to introduce a second process gas to the second plasma region 262. The second process gas comprises may comprise any process gas suitable for treating substrate 225. The second gas injection system may include one or more gas supplies or gas sources, one or more control valves, one or more filters, one or more mass flow controllers, etc.

Referring still to FIG. 2A, the neutral beam source 205 comprises a plasma generation system 240 coupled to the beam chamber 207 and configured to generate the first plasma in the first plasma region 242. The neutral beam source 205 further comprises a plasma heating system 280 coupled to the beam chamber 207 and configured to heat electrons from the first plasma region 242 to form the second plasma in the second plasma region 262.

The plasma generation system 240 may comprise, for example, any one of the plasma sources described above. For example, the plasma generation system 240 may comprise an inductive coil 248 which is coupled to power source 246. The power source 246 may comprise a RF generator that couples RF power through an optional impedance match network to coil 248. RF power is inductively coupled from inductive coil 248 through a dielectric window (not shown) to plasma in the first plasma region 242. A typical frequency for the application of RF power to the inductive coil can range from about 10 MHz to about 100 MHz. In addition, a slotted Faraday shield (not shown) can be employed to reduce capacitive coupling between the inductive coil 248 and plasma.

An impedance match network may serve to improve the transfer of RF power to plasma by reducing the reflected power. Match network topologies (e.g. L-type, π-type, T-type, etc.) and automatic control methods are well known to those skilled in the art.

As illustrated in FIG. 2A, the inductive coil 248 can be a "spiral" coil or "pancake" coil in communication with the plasma from above as in a transformer coupled plasma (TCP). Alternatively, as illustrated in FIG. 2A, the inductive coil may include a helical coil 248'. The design and implementation of an ICP source, or TCP source, is well known to those skilled in the art.

The plasma heating system 280 can comprise a system configured to heat electrons from the first plasma region 242 in the second plasma region 262 by utilizing capacitively coupled plasma (CCP) technology, inductively coupled plasma (ICP) technology, transformer coupled plasma (TCP) technology, surface wave plasma technology, helicon wave plasma technology, or electron cyclotron resonant (ECR) heated plasma technology, or other type of plasma technology understood by one skilled in the art of plasma formation.

For example, the plasma heating system 280 may comprise an inductive coil 288 which is coupled to power source 286. The power source 286 may comprise a RF generator that couples RF power through an optional impedance match network to coil 288. RF power is inductively coupled from inductive coil 288 through a dielectric window (not shown) to plasma in the second plasma region 262. A typical frequency for the application of RF power to the inductive coil can range from about 10 MHz to about 100 MHz. In addition, a slotted Faraday shield (not shown) can be employed to reduce capacitive coupling between the inductive coil 288 and plasma.

An impedance match network may serve to improve the transfer of RF power to plasma by reducing the reflected power. Match network topologies (e.g. L-type, π-type, T-type, etc.) and automatic control methods are well known to those skilled in the art.

Referring still to FIG. 2A, a separation member 260 is disposed between the first plasma region 242 and the second plasma region 262, wherein the separation member 260 comprises one or more openings 264 configured to allow transport of electrons from the first in the first plasma region 242 to the second plasma region 262 in order to form the second plasma in the second plasma region 262. The one or more openings 264 in the separation member 260 may comprise super-Debye length apertures, i.e., the transverse dimension or diameter is larger than the Debye length. The one or more openings 264 may be sufficiently large to permit adequate electron transport, and the one or more openings 264 may be sufficiently small to prevent or reduce electron heating across the separation member 260.

As illustrated in FIG. 2A, electrons are transported from the first plasma region 242 to the second plasma region 262 through separation member 260. The electron transport may be driven by diffusion, or it may be driven by field-enhanced diffusion. As electrons emerge from the separation member 260 and enter the second plasma region 262, they are heated by plasma heating system 280.

Processing system 201 further comprises a neutralizer grid 270 coupled to an outlet of the process chamber 210, and configured to partly or fully neutralize ions from the second plasma region 262. The neutralizer grid 270 comprises one or more apertures 272 for neutralizing ion species as these species pass through. The neutralizer grid 270 may be coupled to ground or it may be electrically biased. The neutralizer grid 270 may be a sub-Debye neutralizer grid. The one or more apertures 272 may be, for instance, approximately 1 mm in diameter and 12 mm in length.

Furthermore, processing system 201 comprises a vacuum pumping system coupled to the neutral beam source 205 and configured to pump the first plasma region 242 and the second plasma region 262 within the neutral beam source 205, and coupled to the process chamber 210 and configured to pump the processing space 252 within the process chamber 210. As shown in FIG. 2A, the vacuum pumping system can comprise a first vacuum pumping system 230 coupled to the process chamber 210 and configured to evacuate the process chamber 210. Additionally, the vacuum pumping system can comprise a second vacuum pumping system 265 coupled to the neutral beam source 205 and configured to evacuate the neutral beam source 205.

The first vacuum pumping system 230 can, for example, comprise a first vacuum pump coupled to processing space 252 through a first exhaust duct, and an optional first vacuum valve 232. The second vacuum pumping system 265 can, for example, comprise a second vacuum pump configured to access second plasma region 262 through a pumping manifold 268 coupled to one or more openings 274 formed in neutral beam source 205. Exhaust gases in the second plasma region 262 may pass through the one or more openings 274, enter a pumping space 276, and exit through pumping manifold 268 into the second vacuum pump. The second vacuum pumping system 265 may include a second vacuum valve 266 to adjust the pumping speed delivered to the second plasma region 262.

Figure 2B:
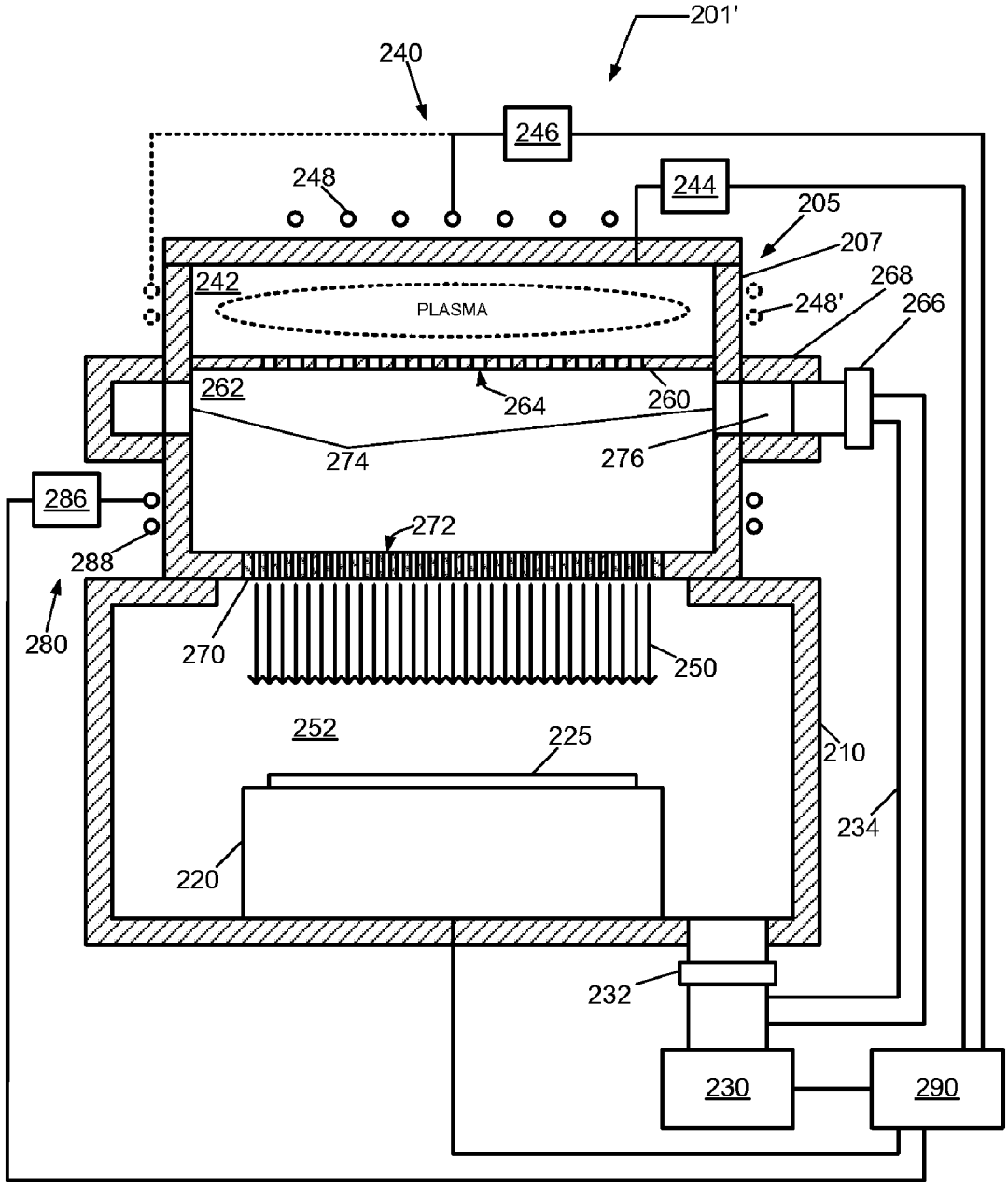
FIG. 2B presents a neutral beam source coupled to a processing system according to an embodiment.

Alternatively, as shown in FIG. 2B for processing system 201', the vacuum pumping system can comprise a single vacuum pumping system 230 coupled to the processing chamber 210 and configured to evacuate the processing chamber 210, and coupled to the neutral beam source 205 through duct 234 and configured to evacuate the neutral beam source 205. The vacuum pumping system 230 can, for example, comprise a vacuum pump coupled to processing space 252 through a first exhaust duct, and the first vacuum valve 232. Additionally, the vacuum pump is coupled to the second plasma region 262 through the pumping manifold 268 coupled to one or more openings 274 formed in neutral beam source 205. Exhaust gases in the second plasma region 262 may pass through the one or more openings 274, enter a pumping space 276, and exit through pumping manifold 268 into the second vacuum pump. A second vacuum valve 262 is utilized to adjust the pumping speed delivered to the second plasma region 262.

In the pumping configuration depicted in FIG. 2A, vacuum pumping system 230 evacuates processing space 252 and second vacuum pumping system 265 evacuates the first plasma region 242 and the second plasma region 262. Returning now to the example provided earlier (i.e., a flow conductance of approximately C~100 l/sec for neutralizer grid 248, a gas pressure of approximately $P_1$~30 mtorr in the first plasma region 242, and a gas pressure of approximately $P_2$~0.1 mtorr in processing space 252), the pumping speed of vacuum pumping system 230 may, for instance, be approximately 3000 l/sec and the pumping speed of second vacuum pumping system 265 may, for instance, be approximately 1000 l/sec.

It is desirable to minimize the (thermal) gas load through the neutralizer grid 270. Therefore, for example, the pumping speed delivered directly to the second plasma region 262 can be selected to be approximately ten (10) times greater than the flow conductance of the neutralizer grid 270. In this example, approximately 90% of the gas flow exiting from the second plasma region 262 is exhausted to the second vacuum pumping system 265 while the remaining approximately 10% of the gas flow exiting from the second plasma region 262 is exhausted to vacuum pumping system 230. Since the gas load through the neutralizer grid 270 is reduced by approximately an order of magnitude, the requirement for the pumping speed delivered to the processing space 252 is lessened by an order of magnitude.

In continuing this example, if the pumping speed for the second vacuum pumping system 265 is selected to be approximately 1000 l/sec, then the flow conductance between the inlet of the second pumping system 265 and the second plasma region 262 should be sufficiently large such that the actual pumping speed delivered to the second plasma region 262 is substantially equivalent to the pumping speed at the inlet to the second vacuum pumping system 265. For instance, if the pumping speed at the inlet to the second vacuum pumping system 265 is $S_{inlet}$=1000 l/sec and the flow conductance (between the second vacuum pumping system and the plasma space) is $C_{plasma}$=10,000 l/sec, then the pumping speed delivered to the second plasma region 262 is:

$$S_{plasma}=S_{inlet}*C_{plasma}/(S_{inlet}+C_{plasma})=909 \text{ l/sec.}$$

Alternatively, for instance, if the pumping speed at the inlet to the second vacuum pumping system 265 is $S_{inlet}$=2000 l/sec and the flow conductance (between the second vacuum pumping system and the plasma space) is $C_{plasma}$=2000 l/sec, then the pumping speed delivered to the second plasma region 262 is:

$$S_{plasma}=S_{inlet}*C_{plasma}/(S_{inlet}+C_{plasma})=1000 \text{ l/sec.}$$

In order to provide a flow conductance of 10,000 l/sec, the height of the one or more openings 274 may, for instance, be approximately 20 cm which, for a 40 cm diameter neutral beam source, gives a flow conductance of:

$$C_{opening}\sim 10*A_{opening}(\text{cm}^2)=25{,}133 \text{ l/sec,}$$

and the cross-section of annular space 276 can be 50 cm by 50 cm which gives a flow conductance of:

$C_{annular}\sim 10*A_{annular}(\text{cm}^2)=25{,}000$, such that the total flow conductance becomes:

$$C_{TOTAL} \sim C_{annular} C_{opening} / (C_{annular} + C_{opening}) = 12{,}533 \text{ l/sec.}$$

In yet another example, the neutral beam source can be configured to produce a divergent hyperthermal neutral beam. In a divergent hyperthermal neutral beam, the neutralizer grid flow conductance is larger than its sub-Debye counterpart. As a result, vacuum valve 232 can be utilized to adjust the pumping speed delivered to processing space 252 and, hence, adjust the thermal neutral flux through the neutralizer grid 270 to processing space 252, which can, in turn, be utilized to adjust and/or control the process chemistry at the substrate surface.

Referring still to FIG. 2A, the neutralizer grid 270 is desirably coupled to electrical ground (i.e., RF ground), as is the process chamber 210. However, in order to enhance acceleration of ions in the second plasma region 262 to the neutralizer grid 270 where they are neutralized to form the neutral beam, other portions of neutral beam source 205, including pumping manifold 268 can be electrically biased with a time varying boundary voltage $V_b(t)$. The boundary voltage can include a RF voltage at a RF frequency consistent with the power source 246 (or 286) utilized in the plasma generation system 240 (or plasma heating system 280). When an electrical bias is utilized, the plasma potential $V_p(t)$ for plasma in the second plasma region 262 is raised to a value greater than its natural potential. Therein, the plasma potential follows the positive phase of the boundary voltage $V_b(t)$ and remains a positive voltage (near zero volts) during the negative phase of the boundary voltage.

During electrical biasing, ions in the plasma are subjected to a voltage gradient between the plasma potential and the voltage of the neutralizer grid, i.e., $V_p(t)-V_{grid}$(e.g., $V_{grid}\sim 0$ volts), causing ion acceleration to the neutralizer grid 270 where the ions are neutralized to form the neutral beam. Therefore, the pumping manifold 268 is electrically isolated from ground with a sufficiently high RF impedance. Furthermore, second vacuum pumping system 265 is electrically coupled to the pumping manifold 268, wherein the electrical connection is either a DC (direct current) coupling or a RF reactive coupling with a low RF impedance (such as a low capacitance coupling). Consequently, the second vacuum pumping system 265 is electrically isolated from the foreline (or outlet vacuum plumbing).

At the outlet to the second vacuum pumping system 265, plasma entering the vacuum pump is neutralized and it is exhausted to an electrically grounded roughing pump (as is standard in conventional vacuum systems). The neutralization of plasma entering the second vacuum pumping system occurs when the rotor and stator blade rows act as neutralizing surfaces for the incident plasma. Alternatively, the second vacuum pumping system 265 can be coupled to RF ground. However, if so, a neutralization device should be utilized to neutralize plasma entering the second vacuum pumping system 265 in order to prevent damage (i.e., sputtering) of the interior of the vacuum pump.

Vacuum pumping system 130 (or 230) and second vacuum pumping system 265 can, for example, include a turbo-molecular vacuum pump (TMP) capable of a pumping speed up to 5000 liters per second (and greater) and a vacuum valve (or second vacuum valve), such as a gate valve, for throttling the pressure in processing space 152 or 252 (or the second plasma region 262). Where greater pumping speed is necessary, one or more vacuum pumps may be utilized. For example, if a pumping speed of 30,000 l/sec is required, then a plurality of vacuum pumps may be used. Furthermore, a device for monitoring chamber pressure (not shown) can be coupled to the process chamber 210. The pressure measuring device can be, for example, a Type 628B Baratron absolute capacitance manometer commercially available from MKS Instruments, Inc. (Andover, Mass.).

Referring to FIGS. 1, 2A and 2B, processing system 101 (or 201, 201') can comprise a substrate temperature control system coupled to the substrate holder 120 (or 220) and configured to adjust and control the temperature of substrate 125 (or 225). The substrate temperature control system comprises temperature control elements, such as a cooling system including a re-circulating coolant flow that receives heat from substrate holder 120 (or 220) and transfers heat to a heat exchanger system (not shown), or when heating, transfers heat from the heat exchanger system. Additionally, the temperature control elements can include heating/cooling elements, such as resistive heating elements, or thermoelectric heaters/coolers, which can be included in the substrate holder 120 (or 220), as well as the chamber wall of the process chamber 110 (or 210) and any other component within the processing system 101 (or 201, 201').

In order to improve the thermal transfer between substrate 125 (or 225) and substrate holder 120 (or 220), substrate holder 120 (or 220) can include a mechanical clamping system, or an electrical clamping system, such as an electrostatic clamping system, to affix substrate 125 (or 225) to an upper surface of substrate holder 120 (or 220). Furthermore, substrate holder 120 (or 220) can further include a substrate backside gas delivery system configured to introduce gas to the back-side of substrate 125 (or 225) in order to improve the gas-gap thermal conductance between substrate 125 (or 225) and substrate holder 120 (or 220). Such a system can be utilized when temperature control of the substrate is required at elevated or reduced temperatures. For example, the substrate backside gas system can comprise a two-zone gas distribution system, wherein the helium gas gap pressure can be independently varied between the center and the edge of substrate 225.

Referring still to FIGS. 1, 2A, and 2B, processing system 101 (or 201, 201') can further comprise a controller 190 (or 290). Controller 190 (or 290) comprises a microprocessor, memory, and a digital I/O port capable of generating control signals sufficient to communicate and activate inputs to processing system 101 (or 201, 201') as well as monitor outputs from processing system 101 (or 201, 201'). Moreover, controller 190 (or 290) can be coupled to and can exchange information with neutral beam source 105 (or 205) including first gas injection system 144 (or 244), optional second gas injection system, first power source 146 (or 246), second power source 186 (or 286) and neutralizer grid 170 (or 270), substrate holder 120 (or 220), vacuum pumping system 130, first vacuum pumping system 230, and second vacuum pumping system 265. For example, a program stored in the memory can be utilized to activate the inputs to the aforementioned components of processing system 101 (or 201, 201') according to a process recipe in order to perform the method of treating substrate 125 (or 225).

However, the controller 190 (or 290) may be implemented as a general purpose computer system that performs a portion or all of the microprocessor based processing steps of the invention in response to a processor executing one or more sequences of one or more instructions contained in a memory. Such instructions may be read into the controller memory from another computer readable medium, such as a hard disk or a removable media drive. One or more processors in a multi-processing arrangement may also be employed as the controller microprocessor to execute the sequences of instructions contained in main memory. In alternative embodiments, hard-wired circuitry may be used in place of or in combination with software instructions. Thus, embodiments are not limited to any specific combination of hardware circuitry and software.

The controller 190 (or 290) includes at least one computer readable medium or memory, such as the controller memory, for holding instructions programmed according to the teachings of the invention and for containing data structures, tables, records, or other data that may be necessary to implement the present invention. Examples of computer readable media are compact discs, hard disks, floppy disks, tape, magneto-optical disks, PROMs (EPROM, EEPROM, flash EPROM), DRAM, SRAM, SDRAM, or any other magnetic medium, compact discs (e.g., CD-ROM), or any other optical medium, punch cards, paper tape, or other physical medium with patterns of holes, a carrier wave (described below), or any other medium from which a computer can read.

Stored on any one or on a combination of computer readable media, the present invention includes software for controlling the controller 190 (or 290), for driving a device or devices for implementing the invention, and/or for enabling the controller to interact with a human user. Such software may include, but is not limited to, device drivers, operating systems, development tools, and applications software. Such computer readable media further includes the computer program product of the present invention for performing all or a portion (if processing is distributed) of the processing performed in implementing the invention.

The computer code devices of the present invention may be any interpretable or executable code mechanism, including but not limited to scripts, interpretable programs, dynamic link libraries (DLLs), Java classes, and complete executable programs. Moreover, parts of the processing of the present invention may be distributed for better performance, reliability, and/or cost.

The term "computer readable medium" as used herein refers to any medium that participates in providing instructions to the processor of the controller 190 (or 290) for execution. A computer readable medium may take many forms, including but not limited to, non-volatile media, volatile media, and transmission media. Non-volatile media includes, for example, optical, magnetic disks, and magneto-optical disks, such as the hard disk or the removable media drive. Volatile media includes dynamic memory, such as the main memory. Moreover, various forms of computer readable media may be involved in carrying out one or more sequences of one or more instructions to processor of controller for execution. For example, the instructions may initially be carried on a magnetic disk of a remote computer. The remote computer can load the instructions for implementing all or a portion of the present invention remotely into a dynamic memory and send the instructions over a network to the controller 190 (or 290).

Controller 190 (or 290) may be locally located relative to the processing system 101 (or 201, 201'), or it may be remotely located relative to the processing system 101 (or 201, 201') via an internet or intranet. Thus, controller 190 (or 290) can exchange data with the processing system 101 (or 201, 201') using at least one of a direct connection, an intranet, or the internet. Controller 190 (or 290) may be coupled to an intranet at a customer site (i.e., a device maker, etc.), or coupled to an intranet at a vendor site (i.e., an equipment manufacturer). Furthermore, another computer (i.e., controller, server, etc.) can access controller 190 (or 290) to exchange data via at least one of a direct connection, an intranet, or the internet.

Figure 3:
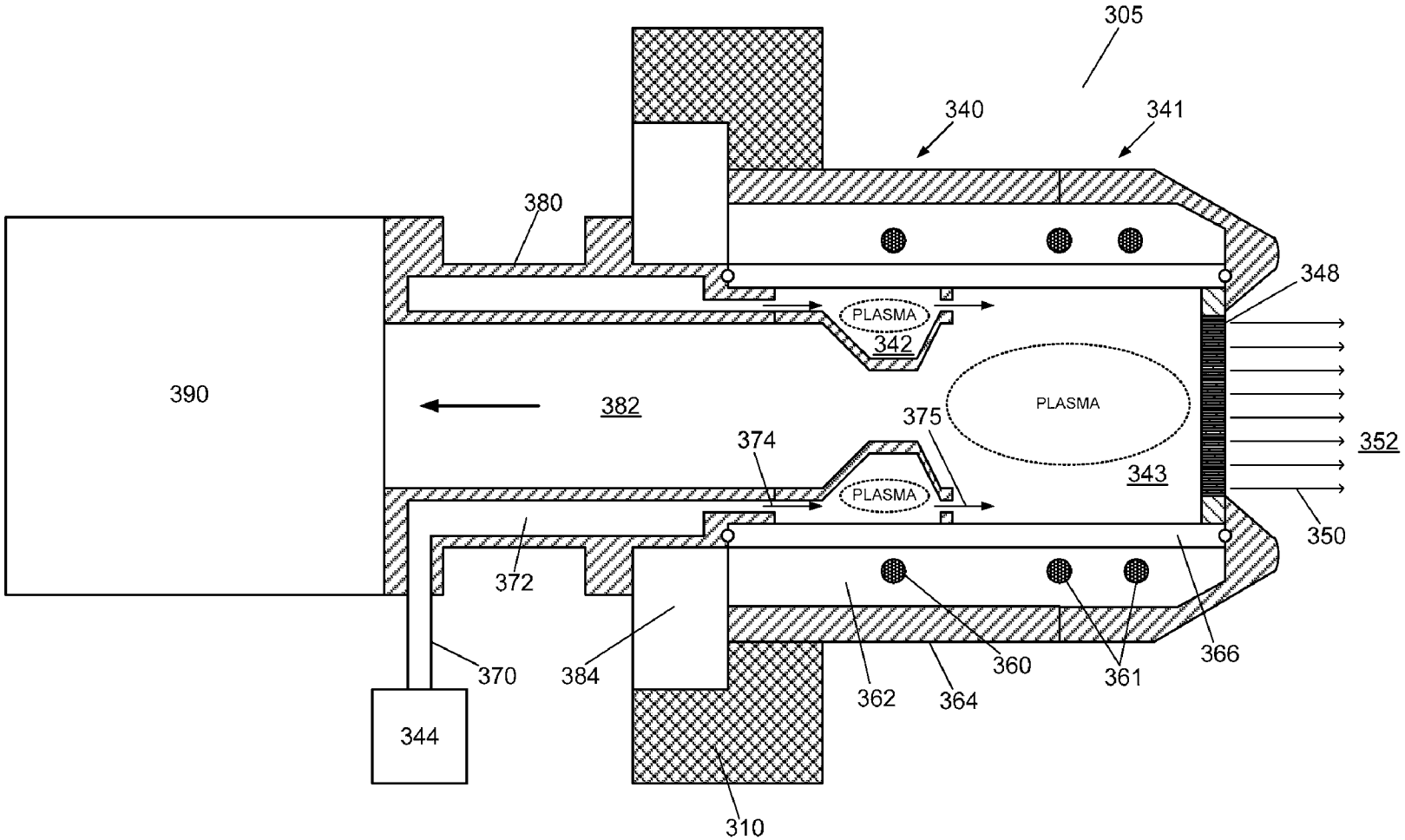
FIG. 3 presents a neutral beam source coupled to a processing system according to an embodiment.

Referring now to FIG. 3, wherein like reference numerals designate identical or corresponding parts throughout the several views, a neutral beam source 305 configured to produce a hyperthermal neutral beam, and configured to couple with a processing chamber 310 is provided according to an embodiment of the invention.

Referring still to FIG. 3, the neutral beam source 305 comprises a plasma generation system 340 configured to generate plasma in a plasma region 342 therein. The neutral beam source 305 further comprises a plasma heating system 341 configured to heat electrons from the first plasma region 342 in a second plasma region 343. Additionally, the neutral beam source 305 comprises a gas injection system 344 coupled to plasma generation system 340 and configured to supply an ionizable and dissociative gas mixture to the plasma generation system 340 in the first plasma region 342. A power source (not shown) coupled to plasma generation system 340 is configured to couple power to the gas mixture in the first plasma region 342, and another power source (not shown) coupled to plasma heating system 341 is configured to couple power to the gas mixture in the second plasma region 343. Furthermore, a neutralizer grid 348 is coupled to the neutral beam source 305 and configured to introduce neutral beam 350 to a processing space 352.

The power source(s) may be a variable power source and may include a radio frequency (RF) generator and an impedance match network. For example, the RF frequency can be 13.56 MHz.

As illustrated in FIG. 3, plasma generation system 340 can comprise a helical coil 360 configured to inductively couple electrical power to plasma in the first plasma region 342. The plasma generation system 340 comprises an inductive coil cavity 362 formed by a plasma source housing 364 and process tube 366, within which helical coil 360 is contained. Helical coil 360 encircles process tube 366, and inductively couples power through process tube 366 into first plasma region 342. The process tube 366 can, for example, comprise a dielectric material, such as quartz or alumina. Additionally, plasma source housing 364 can be fabricated from aluminum, and it can be coupled to electrical ground. Furthermore, a cooling fluid may be introduced to inductive coil cavity 362 in order to remove heat from power dissipation.

The inductive coil 360 can include a first end coupled directly to electrical ground, or indirectly to electrical ground through, for instance, a capacitor. Additionally, inductive coil 360 can include a second end coupled to the source of power, or it may be an open end. In the latter, a tap location is positioned between the first and second ends for the coupling of power. For example, the inductive coil 360 may be designed as a quarter-wave or half-wave resonator.

Additionally, as illustrated in FIG. 3, plasma heating system 341 can comprise a helical coil 361 configured to inductively couple electrical power to plasma in the second plasma region 343.

Referring still to FIG. 3, an evacuation housing 380 is coupled to the plasma generation system 340 and is configured to receive plasma gases and provide access to vacuum pumping system 390 through exhaust duct 382. An insulation ring 384 is positioned between the plasma generation system 340 and the evacuation housing 380, and between the processing chamber 310 and the evacuation housing 380. The evacuation housing 380 may further serve as an accelerator in order to accelerate ions formed in the plasma towards the neutralizer grid 348, whereby the evacuation housing 380 is electrically biased with a voltage $V_b(t)$. The boundary voltage can include a RF voltage at a RF frequency consistent with the power source utilized in the plasma generation system 340.

When an electrical bias is utilized the plasma potential $V_p(t)$ is raised to a value greater than its natural potential. Therein, the plasma potential follows the positive phase of the boundary voltage $V_b(t)$ and remains a positive voltage (near zero volts) during the negative phase of the boundary voltage. During electrical biasing, ions in the plasma are subjected to a voltage gradient between the plasma potential and the voltage of the neutralizer grid, i.e., $V_p(t)-V_{grid}$ (e.g., 0 volts), causing ion acceleration to the neutralizer grid 348 where the ions are neutralized to form the neutral beam.

When the evacuation housing 380 is electrically biased, the vacuum pumping system 390 can be electrically floating (from ground) and can be electrically coupled to the evacuation housing 380. Therefore, vacuum pumping system 390 can be coupled directly to evacuation housing 380; however, the vacuum pumping system 390 must be electrically insulated from the foreline (or outlet vacuum plumbing).

Furthermore, as illustrated in FIG. 3, process gas is introduced to the first plasma region 342 from gas injection system 344 through an evacuation housing 380. Gas injection system 344 comprises a gas supply line 370 coupled to an annular gas plenum 372 that distributes process gas to a plurality of injection nozzles 374. Plasma gases 375 emerge from the first plasma region 342 through an annular opening (or annular array of openings) and enter the second plasma region 343.

Figure 4:
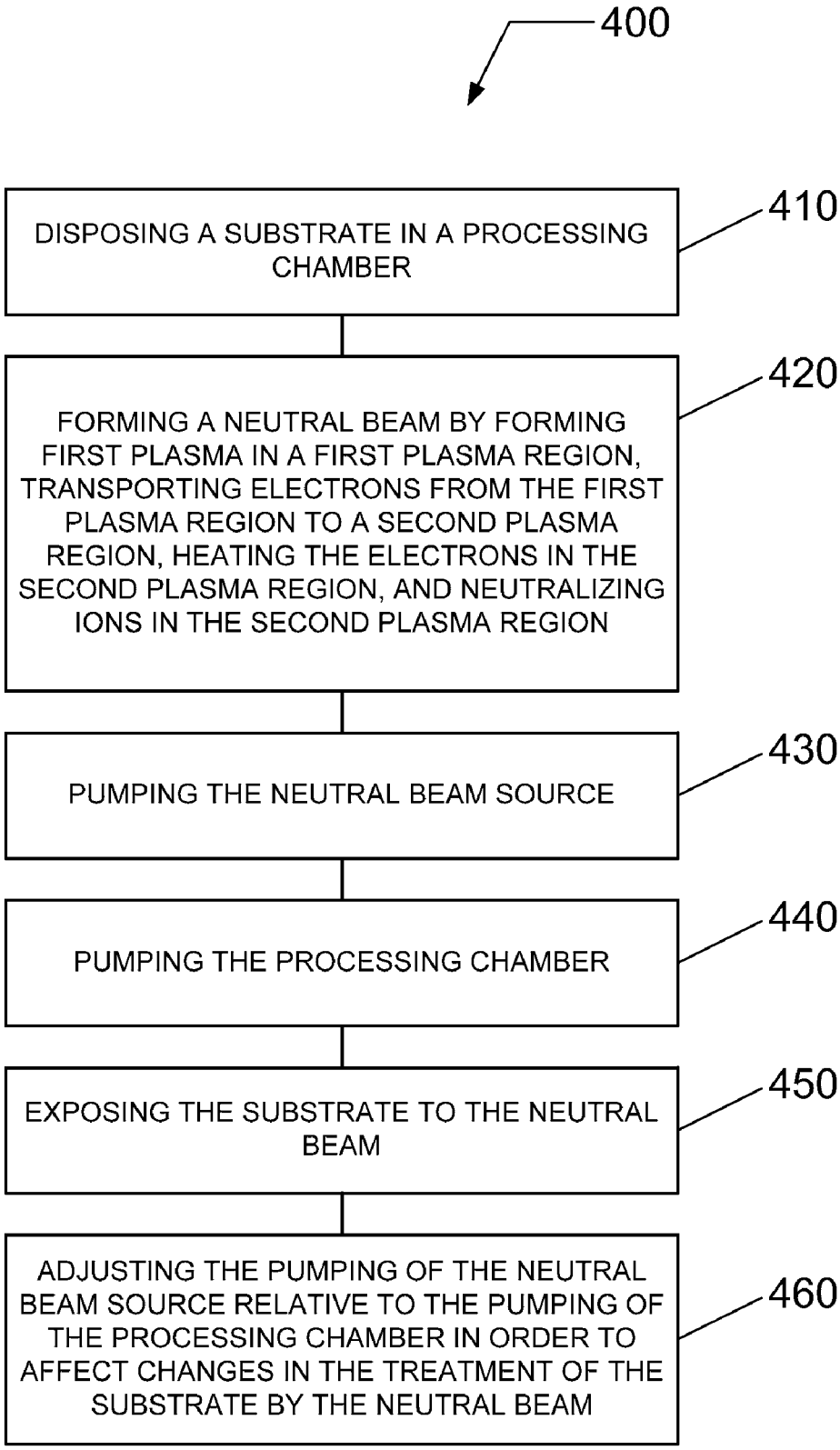
FIG. 4 illustrates a method of operating a neutral beam source coupled to a processing system configured to treat a substrate according to an embodiment.

Referring now to FIG. 4, a flow chart 400 of a method for operating a processing system utilizing a neutral beam source to treat a substrate according to an embodiment of the invention. Flow chart 400 begins in 410 with disposing a substrate in a processing chamber configured to facilitate the treatment of the substrate using a neutral beam.

In 420, a neutral beam is formed using a neutral beam source coupled to the processing chamber. The neutral beam can be provided using a neutral beam source as described in FIGS. 1 through 3. For example, a neutral beam is generated by forming a first plasma in a first plasma region, transporting electrons from the first plasma in the first plasma region to a second plasma region, heating the electrons in the second plasma region, and neutralizing ions from the second plasma region.

In 430, a fraction of the gaseous medium in the neutral beam source is pumped by a vacuum pumping system. In 440, gases entering the processing chamber from the neutral beam source are pumped by another vacuum pumping system. The vacuum pumping system utilized to pump the neutral beam source and the other vacuum pumping system utilized to pump the processing chamber may utilize the same vacuum pump, or they may utilize independent vacuum pumps.

In 450, the substrate is exposed to the neutral beam that exits the neutral beam source and enters the processing chamber in order to treat the substrate. In 460, the pumping speed delivered to the neutral beam source is adjusted relative to the pumping speed delivered to the processing chamber in order to affect changes in the treatment of the substrate. For example, the pumping speed delivered to the neutral beam source can be reduced relative to the pumping speed delivered to the processing chamber in order to affect an increase in the neutral flux to the substrate. Conversely, the pumping speed delivered to the neutral beam source can be increased relative to the pumping speed delivered to the processing chamber in order to affect a reduction in the neutral flux to the substrate.

Although only certain embodiments of this invention have been described in detail above, those skilled in the art will readily appreciate that many modifications are possible in the embodiments without materially departing from the novel teachings and advantages of this invention. Accordingly, all such modifications are intended to be included within the scope of this invention.

What is claimed is:

1. A processing system configured to treat a substrate, comprising:

a neutral beam source comprising:

a beam chamber comprising a first plasma region configured to receive a first process gas at a first pressure and a second plasma region disposed downstream of said first plasma region and configured to receive said first process gas from said first plasma region at a second pressure, a first gas injection system coupled to said beam chamber and configured to introduce said first process gas to said first plasma region, a plasma generation system coupled to said beam chamber and configured to generate a first plasma in said first plasma region from said first process gas, a separation member disposed between said first plasma region and said second plasma region, wherein said separation member comprises one or more openings configured to allow transport of electrons from said first plasma region to said second plasma region, a plasma heating system, independently operable from said plasma generation system, coupled to said beam chamber and configured to heat said electrons in said second plasma region to form a second plasma, and a neutralizer grid coupled to an outlet of said neutral beam source and configured to neutralize a flow of ions from said second plasma through said neutralizer grid in order to form said neutral beam;

a process chamber coupled to said neutral beam source and configured to receive said neutral beam in a processing space, wherein said process chamber comprises a substrate holder configured to support said substrate and position said substrate for treatment by said neutral beam; and a vacuum pumping system coupled to said process chamber and configured to pump said processing space in said process chamber, and coupled to said neutral beam source and configured to pump said first plasma region or said second plasma region or both in a neutral beam source.

2. The processing system of claim 1, wherein said vacuum pumping system comprises a vacuum pump coupled to said processing space through a first exhaust duct and a first vacuum valve and coupled to said first plasma region or said second plasma region or both through a second exhaust duct and a second vacuum valve.

3. The processing system of claim 2, wherein said first vacuum valve can be adjusted in order to adjust a pumping speed coupled to said processing space, and wherein said second vacuum valve can be adjusted in order to adjust the pumping speed coupled to said first plasma region or said second plasma region or both.

4. The processing system of claim 1, wherein said vacuum pumping system comprises a first vacuum pump coupled to said processing space, and a second vacuum pump coupled to said first plasma region or said second plasma region or both.

5. The processing system of claim 4, wherein said first vacuum pump is coupled to said processing space through a first exhaust duct and a first vacuum valve, and said second vacuum pump is coupled to said first plasma region or said second plasma region or both through a second exhaust duct and a second vacuum valve.

6. The processing system of claim 5, wherein said first vacuum valve can be adjusted in order to adjust a pumping speed coupled to said processing space, and wherein said second vacuum valve can be adjusted in order to adjust the pumping speed coupled to said first plasma region or said second plasma region or both.

7. The processing system of claim 1, wherein said neutral beam source further comprises a pumping manifold disposed between said neutral beam source and said vacuum pumping system, said pumping manifold is configured to receive gases from said first plasma region or said second plasma region or both through at least one opening in said neutral beam source and exhaust said gases through an exhaust duct to said vacuum pumping system, wherein said pumping manifold surrounds a periphery of said neutral beam source.

8. The processing system of claim 1, wherein said plasma generation system comprises a power source configured to couple first power to said first process gas, and wherein said plasma heating system comprises a second power source, independently operable from said power source, configured to couple second power to electrons transported to said second plasma region from said first plasma region.

9. The processing system of claim 8, wherein said plasma generation system comprises an inductive coil configured to inductively couple electrical power to said first process gas in said first plasma region from said first power source, said inductive coil surrounds said first plasma region or said inductive coil is arranged in a plane adjacent a surface bounding said first plasma region.

10. The processing system of claim 5, wherein said power source comprises a radio frequency (RF) power source, and said second power source comprises another RF power source.

11. The processing system of claim 8, wherein said plasma heating system comprises a second inductive coil, independent of said inductive coil, configured to inductively couple electrical power to said electrons in said second plasma region from said second power source, said second inductive coil surrounds said second plasma region.

12. The processing system of claim 4, further comprising:

a controller coupled to said neutral beam source, said processing chamber, said first vacuum pump, and said second vacuum pump, and configured to adjust or control said neutral beam by varying at least one of a first power coupled by said plasma generation system to said neutral beam source, a second power coupled by said plasma heating system to said neutral beam source, a composition of said first process gas coupled to said neutral beam source, a flow rate of said first process gas coupled to said neutral beam source, a first pumping speed coupled to said process chamber, a second pumping speed coupled to said neutral beam source, or a temperature of said substrate, or a combination of one or more thereof.

13. The processing system of claim 1, wherein said neutralizer grid comprises a plurality of openings through which ions from said second plasma region enter and said neutral beam exits.

14. The processing system of claim 13, wherein one or more of said plurality of openings comprises a diameter less than or equal to a Debye length.

15. The processing system of claim 1, wherein said neutralizer grid is electrically grounded.

16. The processing system of claim 1, wherein said separation member is configured to sustain a pressure ratio between said first pressure and said second pressure greater than or equal to a value of about 10.

17. A neutral beam source configured to be coupled with a process chamber for treating a substrate, comprising:

a beam chamber comprising a first plasma region configured to receive a first process gas at a first pressure and a second plasma region disposed downstream of said first plasma region and configured to receive said first process gas from said first plasma region at a second pressure, a first gas injection system coupled to said beam chamber and configured to introduce said first process gas to said first plasma region, a plasma generation system coupled to said beam chamber and configured to generate a first plasma in said first plasma region from said first process gas, a separation member disposed between said first plasma region and said second plasma region, wherein said separation member comprises one or more openings configured to allow transport of electrons from said first plasma region to said second plasma region, a plasma heating system, independently operable from said plasma generation system, coupled to said beam chamber and configured to heat said electrons in said second plasma region to form a second plasma, and a neutralizer grid coupled to an outlet of said neutral beam source and configured to neutralize a flow of ions from said second plasma through said neutralizer grid in order to form said neutral beam.

18. A method for treating a substrate with a neutral beam, comprising:

disposing said substrate in a processing chamber configured to treat said substrate with said neutral beam;

forming said neutral beam using a neutral beam source coupled to said processing chamber, wherein said forming comprises creating a first plasma in a first plasma region using a plasma generation system, transporting electrons from said first plasma in said first plasma region to a second plasma region, heating said electrons in said second plasma region using a plasma heating system, independently operable from said plasma generation system, and neutralizing ions from said second plasma region;

controlling a first power coupled to said first plasma region using said plasma generation system;

controlling a second power coupled to said second plasma region, independently from said first power, using said plasma heating system;

pumping said neutral beam source using a vacuum pumping system coupled to said neutral beam source;

pumping said processing chamber using said vacuum pumping system coupled to said processing chamber; and exposing said substrate to said neutral beam.

19. The processing system of claim 1, wherein said neutral beam source further comprises:

a second gas injection system, independently operable from said first gas injection system, coupled to said beam chamber and configured to introduce a second process gas directly to said second plasma region.

20. The processing system of claim 1, wherein said neutralizer grid is electrically biased.

* * * * *